United States Patent [19]

Griessen et al.

[11] 4,423,964

[45] Jan. 3, 1984

[54] TIMEPIECE WITH ALARM AND TIME SETTING DEVICE

[75] Inventors: Jean-Bernard Griessen, Cornaux; Willy Cleusix, Le Landeron, both of Switzerland

[73] Assignee: Ebauches Electroniques S.A., Marin, Switzerland

[21] Appl. No.: 368,882

[22] Filed: Apr. 15, 1982

[30] Foreign Application Priority Data

Apr. 23, 1981 [CH] Switzerland ..... 2661/81

[51] Int. Cl.[3] ..... G04B 23/02; G04B 19/24

[52] U.S. Cl. ..... 368/74; 368/34; 368/185; 368/319

[58] Field of Search ..... 368/31, 34, 69–70, 368/72–74, 185, 187, 190–195, 308, 319–321

[56] References Cited

U.S. PATENT DOCUMENTS

| | | | |
|---|---|---|---|
| 3,834,152 | 9/1974 | Nishimura et al. | 368/188 |
| 4,034,551 | 7/1977 | Ushiyama | 368/320 |
| 4,279,029 | 7/1981 | Oda et al. | 368/29 |
| 4,302,828 | 11/1981 | Morokawa et al. | 368/69 |
| 4,344,161 | 8/1982 | Wakai | 368/69 |

*Primary Examiner*—Vit W. Miska

*Attorney, Agent, or Firm*—Philip M. Hinderstein

[57] ABSTRACT

A manually operable setting stem 1 has three stable axial positions defined by a pull out piece 4 cooperating with notches in the head 8*a* of a spring 8. The illustrated position is a pushed in, neutral position. In an intermediate pulled out position, a return bar 9 moves a sliding pinion 12 into engagement with a gear 17 in mesh with a gear 18 which is in turn in mesh with a gear 19 whose axis can swing about the axis of the gear 18. In the intermediate position, rotation of the stem in one sense adjusts a data ring 14 via a star-wheel 20 on the gear 19; rotation in the other sense adjusts the pre-set alarm time via a gear 21. In the fully pulled out position the return bar slides the pinion 12 further inwardly and with it the gear 17 which meshes with a gear 24 for setting the time indicating mechanism. The stem can be pushed in beyond the stable pushed in position to engage the tip 1*a* of the stem with an electrical contact. Such operation alternately turns the alarm mechanism on and off.

5 Claims, 8 Drawing Figures

TIMEPIECE WITH ALARM AND TIME SETTING DEVICE

FIELD OF THE INVENTION

The present invention is concerned with time-pieces having an alarm device and a setting device comprising a setting stem which is rotatable as well as being axially movable and which serves more particularly for correcting the time indicated.

BACKGROUND OF THE INVENTION

In a known timepiece of this type (Japanese patent application published prior to examination under No. 55-12451), the alarm device is rendered operative and inoperative, as required, by a separate member distinct from the rotatable and axially movable stem. A complication results which brings with it an increase in the cost of manufacture of this known timepiece.

One object of the invention is to overcome this disadvantage.

BRIEF SUMMARY OF THE INVENTION

According to the invention, the alarm device is rendered operative and inoperative by the user by means of the setting stem itself. The setting stem, when it is pushed-in neutral position, constitutes a push-button which serves for turning the alarm device on and off. In order to alter the operating condition of the alarm device, that is to say to turn it on and off when it is respectively off or on, it is then sufficient to depress the outer end of the setting stem, which is usually provided with an enlarged head, so as to move the latter into a pushed-in non-stable position.

According to a constructional embodiment which is preferred at the present time, the setting stem is capable of assuming three different stable axial positions: (1) the neutral pushed-in position, (2) a pulled-out intermediate position in which rotation of the stem in one direction makes possible the correction of the means that indicate the day of the month and a rotation of the stem in the other direction makes possible the setting of the time at which the alarm is to go off, and (3) a pulled-out end position in which rotation of the stem in one direction or the other makes possible setting of the indicated time in the advance or retard direction respectively.

BRIEF DESCRIPTION OF THE DRAWINGS

The invention will be described in more detail, by way of example, with reference to the accompanying drawings in which.

DETAILED DESCRIPTION OF THE PREFERRED EMBODIMENT

Figure 1:
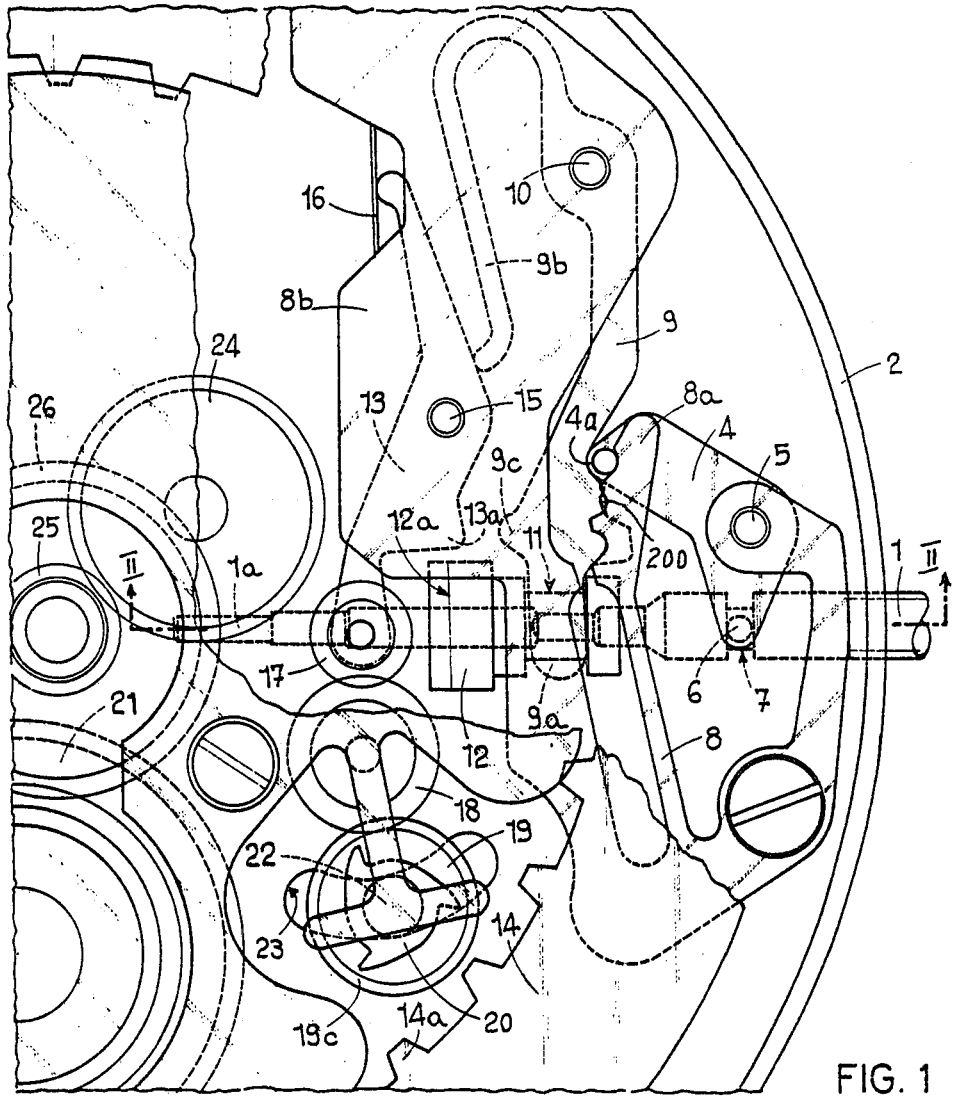
FIG. 1 is a plan view of a part of an electro-mechanical wrist watch illustrating, more particularly the mechanism for setting this watch, which is shown in the stable, pushed-in position of the setting stem.
Figure 3:
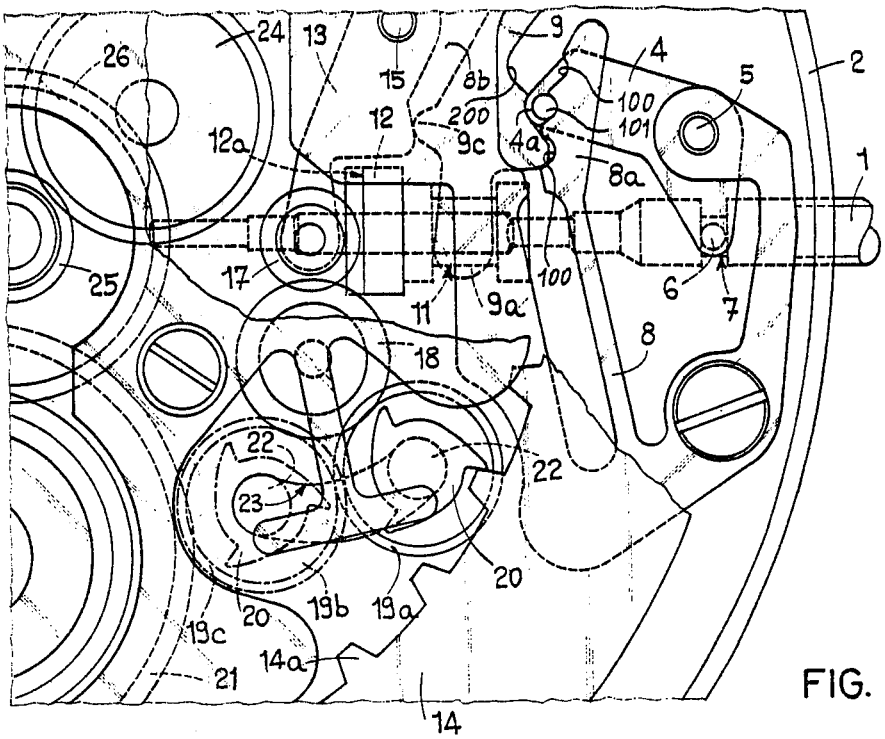
FIGS. 3, 4 and 5 are plan views similar to that of FIG. 1, illustrating the setting mechanims in the intermediate pulled-out and non-stable positions respectively of the setting stem.
Figure 4:
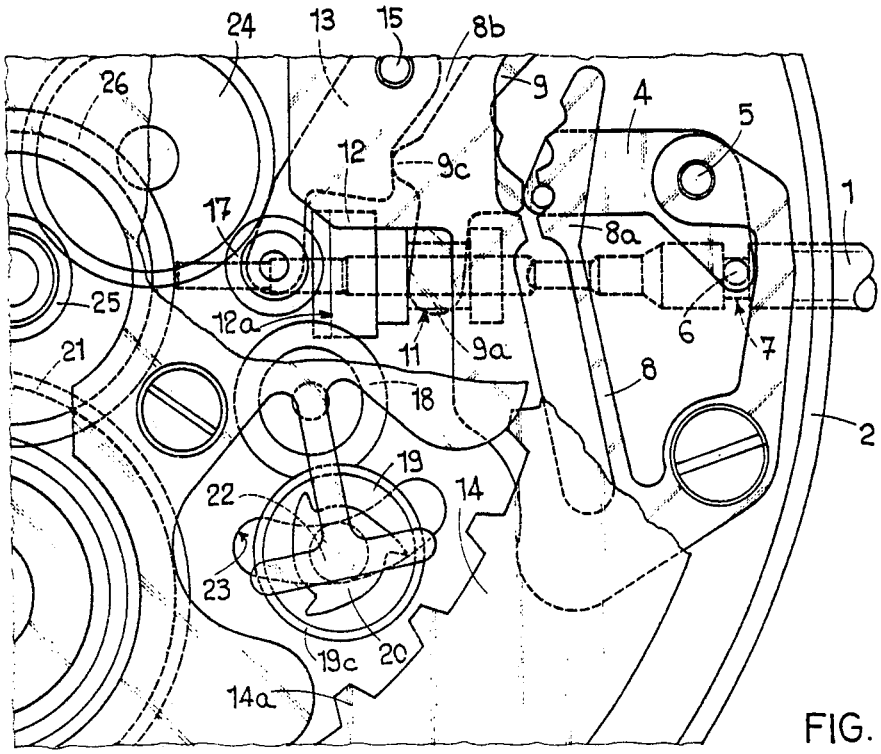

The watch shown in the drawings is an electro-mechanical, calendar, alarm watch. This watch comprises a setting mechanism having a rotatable stem 1, which is axially movable, being capable of occupying three stable axial positions shown in FIGS. 1, 3 and 4 respectively and a non-stable axial position, shown in FIG. 5, into which it can be brought like a push button and in which it is then located beyond its stable pushed in position.

The metal stem 1 is mounted on en electrically insulating plate 2 of the movement, in recess 3 in the plate. In the course of its axial displacements, it actuates a pull out piece 4 which is mounted on a pivot 5 rigid with the plate 2. The pull-out piece 4 carries a pin 6 which is engaged in a groove 7 in the stem. The three stable positions of the stem 1 are determined by the inclined head portion **8*a* of a pull-out piece spring 8, the heel portion of which is indicated by 8*b*. For this purpose, the head 8*a* is formed with three recesses 100 which serve for the reception of a pin 101 carried by the pull-out piece 4. Each recess 100 is associated with one stable axial position of the stem 1. The pushed in position of the stem 1, shown in FIG. 1**, is a rest position of the stem in which it is inoperative.

The setting mechanism furthermore comprises a return bar 9 pivotally mounted at 10 on the plate 2. The end portion **9*a* of the return bar 9 is engaged in the groove 11 of a sliding pinion 12 which is fixed for rotation with the stem 1 and on which it can be displaced axially. The return bar 9 is controlled by the pull-out piece 4, the end portion 4*a* of which remote from the pin 6 can engage selectively in each of the two correspondingly shaped recesses 200 provided in one edge of the return bar 9 adjacent the pull-out piece 4. The setting mechanism also comprises a lever 13 in the form of a flat plate for adjusting the setting of a day of the month indicator 14 and a device (not shown) for adjusting the alarm setting. The lever 13, which is pivotally mounted at 15 on the plate 2, is held between a resilient arm 9*b* which forms part of the return bar 9 and an abutment surface 16 (FIG. 1) which tends to keep it applied against the arm 9*b* of the return bar 9. The displacements of the lever 13 are controlled by the return bar 9 which has a projection 9*c* cooperating with a projection 13*a* on the lever 13. This lever carries a pinion 17 which, when the stem 1 is located in its axially intermediate and pulled-out positions (FIGS. 3 and 4 respectively), is in mesh with the crown teeth 12*a* of the sliding pinion 12**.

Furthermore, when the stem 1 occupies its pushed-in and intermediate positions, the pinion 17 of the setting lever 13 is in mesh with a pinion 18 which in turn is in mesh with a pinion 19 formed integrally with a controlling star wheel 20. The star wheel 20 serves for driving the day of the month indicator 14, while the pinion 19 serves for driving a wheel 21 which is rigid with the device for adjusting the alarm setting.

The pinion 19 is slidable, being mounted on an arbor 22 which is movable along a slot 23 in the plate 2. The slot 23 has the form of a circular arc coaxial with the pinion 18. Depending on the direction of rotation of the stem 1, the pinion 19 is located in either (a) a first working position **19*a* in FIG. 3, a position in which the star wheel 20 engages with an interior ring of gear teeth 14***a* on the day of the month indicator 14, or (b) a second working position 19*b* of the pinion 19 in which the latter is in mesh with the wheel 21. As a result, according to the direction of rotation of the stem 1, either the day of the month indicator 14 or the device for adjusting the alarm setting is operated. Thus, in the intermediate position of the stem 1, the latter makes possible the selective correction of the day of the month setting and of the time at which the alarm is set to operate.

When the stem 1 is in the pulled-out position (FIG. 4), the pinion 17, which is in mesh with the crown teeth 12*a* of the sliding pinion 12, engages the intermediate hand driving wheel which is drivably connected to the centre wheel 25 and the cannon weel 26. Consequently, in this retracted position of the stem 1, the latter makes possible the setting of the watch, acting on the hour and minute hands (not shown).

Figure 2:
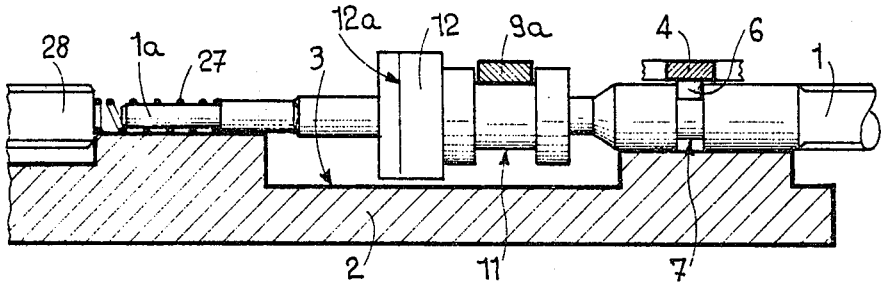
FIG. 2 is a partial elevational view in vertical section along the line II—II of FIG. 1.
Figure 5:
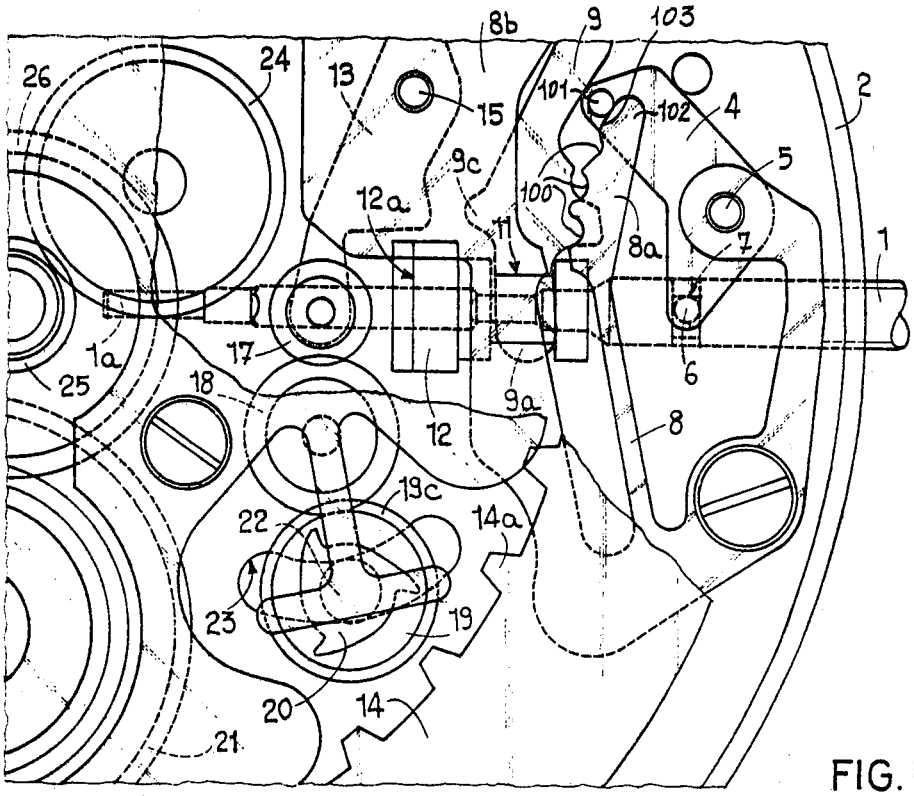

In the non-stable position of the stem 1, shown in FIG. 5, in which the stem is displaced against the action of a return spring 27 (FIG. 2), like a push button, and in which it is located beyond its stable pushed-in position (FIG. 1), the end portion 1*a* of the stem 1 enters into contact with a metal contact 28*a* (FIG. 2) and thus closes an electric switch 28 (FIG. 7) the two elements of which are the contacts 28*a* and the stem 1, this latter being earthed. The switch 28 effects alternately, as a result of each closing thereof, the turning on and off of the alarm mechanism with which the watch is provided in a way which will be described later.

It is to be noted that the head of the spring 8*a* extends beyond the last recess 100 by a free end part extension 102 the edge of which adjacent the recesses 100 has substantially the form of a circular arc centred on the axis of the pivot 5 (see FIG. 5). The part 102 and the edge 103 are of sufficiently large dimensions to enable the pin 101 to bear against the said edge 103 when the end part 1*a* of the stem 1 is in engagement with the contact 28*a*.

Figure 6:
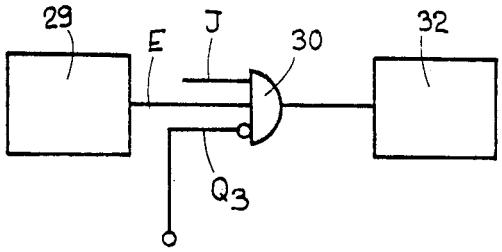
FIG. 6 is a partial block diagram of an alarm device of the watch, according to one embodiment of the invention.

The alarm device of the watch, which is shown diagrammatically in FIG. 6, comprises a device 29, known per se, which is capable of producing a signal E at a predetermined time previously recorded in an electromechanical memory store. The device 29 includes, for example, a wheel mounted so that its position is rotationally adjustable on the plate 2. This wheel, which may be the wheel 21 itself, carries an electrical contact element which is capable of cooperating with another contact element carried by a wheel coaxial with the above-mentioned wheel and driven by the movement of the watch. The device of FIG. 6 also includes an AND gate 30 and three inputs: one of these inputs receives a signal J produced by the output of one of the stages of the dividing circuit 31 (FIG. 7) of the watch, for example a signal composed of pulses at 4096 Hz. Another input of the AND gate 30 receives the above-mentioned signal E produced by the device 29 and the third of these inputs, which is inverted, receives a signal $Q_3$ which is a control signal that can assume two different logical value "0" and "1" and which is produced by a circuit 34 constituting a part of the circuit shown in FIG. 7.

The output signal of the AND gate 30 is applied to the control input of an alarm generating device 32 which, in the case described and shown, is an electro-acoustical transducer producing an acoustical alarm.

Figure 7:
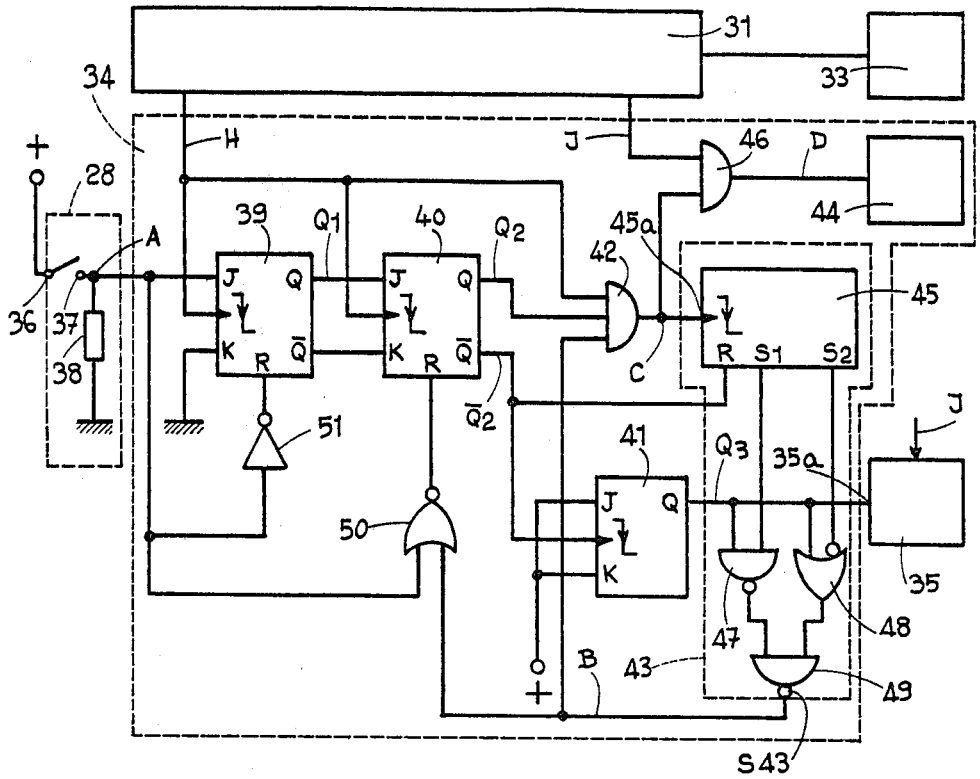
FIG. 7 is a diagram of the control circuit of the alarm device of FIG. 6 according to one constructional embodiment of the invention.

The circuit shown in FIG. 7 comprises a quartz oscillator 33 producing a time base signal, the frequency of which is 32768 Hz., the above mentioned divider circuit 31 which divides this time base signal, the circuit 34 producing the above mentioned signal $Q_3$ and the alarm device shown in detail in FIG. 6 and indicated as a whole by block 35 in FIG. 7.

The circuit 34 responds to the operation of the switch 28 in the following manner to produce the control signal $Q_3$ as follows: on a first brief closure of the switch 28, the signal $Q_3$ assumes the logical value "1". On a second, likewise brief, closure of the switch 28, the signal $Q_3$ assumes the value "0". This signal thus passes alternately to the value "0" and "1" upon each fresh closure of the switch 28. Now, turning on the alarm device 35 corresponds to the state "0" of the circuit 34 and turning off this device corresponds to the state "1".

However, since it must be assumed that the user of the watch does not know the state of the signal $Q_3$ when he depresses the stem 1 to the neutral position, the circuit 34 is arranged to operate so as to control the mechanism 35 in such a manner that, in response to a brief closing of the switch 28, the device 35 emits one acoustic pulse when the signal $Q_3$ is changed over to the value "1" and two acoustic pulses when it is changed over to the value "0".

The switch 28 comprises two contacts 36 and 37, the former (36) being the contact 28*a* (FIG. 2) which is connected to the positive pole of a source (not shown) of electric current. As for the contact 37 of the switch 28, or the output terminal, it is constituted by the end part 1*a* of the stem 1, which is connected via a resistance 38 to earth, to which is also connected the second pole of the source of electric current.

The control circuit 34 comprises two JK flip-flops 39 and 40 which together form anti-surge and synchronising circuit. The circuit 34 contains a third JK flip-flop 41, the state of which is changed over each time the switch 28 is closed and an AND gate 42 which receives a clock pulse signal H, for example a pulsating signal at a frequency of 4 Hz. emanating from the output of one stage of the divider 31. The circuit 34 furthermore comprises a circuit 43 that controls the opening of the AND gate 42 so that this latter allows only one or two pulses of the signal H, depending upon the state of the signal $Q_3$ and an acoustic signal generator 44 which produces the above-mentioned acoustic signal or signals.

On each closing of the switch 28, a signal A, which is present at the output contact 37 of this switch, assumes the logical value "1".

Figure 8:
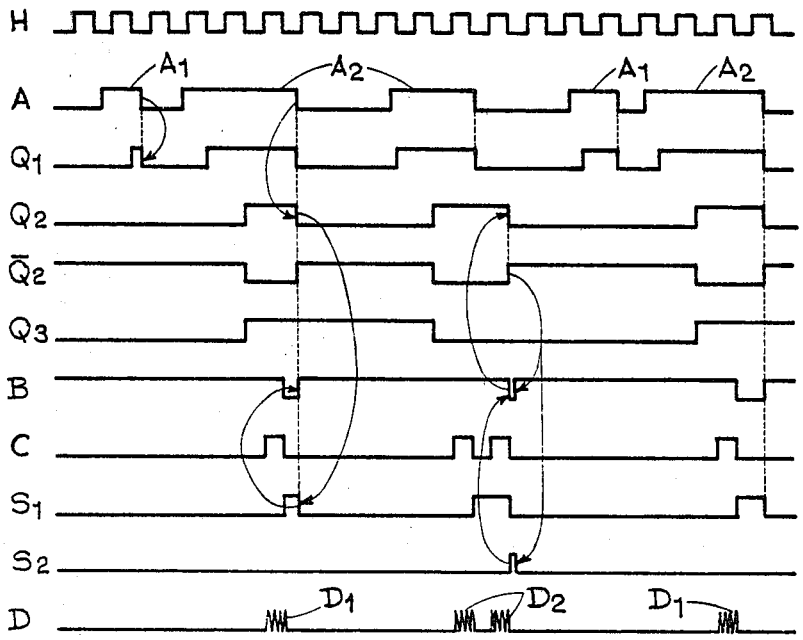
FIG. 8 shows diagrams of the signals present at different points in the circuit of FIG. 7.

FIG. 8 shows the time relationship between various waveforms, including the 4 Hz signal H, the signal A, the signal $Q_1$ that is present at the output Q of the flip-flop 39, the signal $Q_2$ that is present at the output Q of the flip-flop 40, the signal $\overline{Q}_2$ that is present at the output $\overline{Q}$ of the flip-flop 40, the signal $Q_3$ that is present at the output $\overline{Q}$ of the flip-flop 41, the signal B that is present at the output S43 of the circuit 43, a signal C that is present at the output of the AND gate 42, as well as signals $S_1$ and $S_2$ that are present at the output terminals indicated respectively by $S_1$ et $S_2$ and also of a counter 45 (FIG. 7) forming part of the circuit 43.

FIG. 8 likewise shows the waveform of a signal D which is present at the output of an AND gate 46 having two inputs receiving respectively the signal J at 4096 Hz emanating from the divider 31 and the signal C. The signal D is applied to the alarm producing mechanism 44.

As shown in FIG. 7, a short duration pulse $A_1$ of the signal A produces no change in the state of the downstream flip-flop 40 of the anti-surge circuit 39-40, the short duration pulses $A_1$ being due simply to a relatively frequent surge phenomenon in the electrical contacts. On the other hand, when a pulse $A_2$ of sufficient duration is emitted at the output contact 37 of the switch 28, the downstream flip-flop 40 is operated, this operation producing a trailing edge at the terminal $\overline{Q}$ of the downstream flip-flop 40. This has the effect of operating the flip-flop 41, thereby switching the signal $Q_3$ to "1".

The circuit 45 is a counter of trailing edges of the signal C. In the absence of pulses of the signal C, the outputs $S_1$ and $S_2$ of the counter are at zero, the latter being maintained in the "0" state by the signal $\overline{Q_2}$ which is in the state "1" and is applied to the reset-to-zero input R of the said circuit. The signal B being at "1", operation of the downstream flip-flop brings about the opening of the AND gate 42, so that a first pulse of the clock pulse signal H is applied to the counting input 45*a* of the counter 45. The counting of this pulse switches over the signal $S_1$ to "1" which in turn switches the signal B to the state "0" whereby the AND gate 42 is closed. The setting of the signal B to the state "0" also permits the resetting to "0" of the downstream flip-flop 40 by the return to "0" of the signal A. The AND gate 42 is thus once again closed and no pulse is applied to the counting input 45*a* of the counter 45.

If the switch 28 is briefly reclosed, a fresh plate $A_2$ is emitted at the output terminal 37 of this switch. This pulse $A_2$, like the preceding one, brings about the operation of the downstream flip-flop, which sets the signal $Q_2$ in the state "1" and the signal $\overline{Q_2}$ in the state "0". The said trailing edge of the signal $Q_2$ changes over the flip-flop 41, thereby setting the signal $Q_3$ in the state "0". Simultaneously, a "0" signal being applied at the reset-to-zero input R of the counter 45, the latter can count the trailing edges of the signal C applied to its input 45*a*. In addition, the signals B and $Q_2$ being in the state "1", the AND gate 42 is open and allows a first pulse of the clock pulse signal H to pass. The counting of this first pulse sets the output $S_1$ of the counter 45 in the state "1". However, the signal $Q_3$ being at "0", this change of state of the signal $S_1$ does not affect the signal B which remains in the state "1", keeping the AND gate 42 open. A second pulse of the clock pulse signal H is thus applied to the input 45*a*, bringing about the passage of the signal $S_2$ to the state "1", which has the effect of setting the signal B in the state "0", thereby allowing the flip-flop 40 to be reset to zero due to the signal A being in the state "0".

Thus, a first pulse $A_2$ of the signal A brings about the application to the device 44 of a single train of pulses $D_1$, while a second pulse $A_2$ of the signal A brings about the application to the device 44 of two successive trains of pulses $D_2$.

The connections of the different constituent elements of the circuit 34 of FIG. 7 are indicated as follows. The terminal J of the flip-flop 39 is connected to the output terminal 37 of the switch 28. The terminal K of the flip-flop 39 is connected to earth. The terminal J of the flip-flop 40 is connected to the terminal Q of the flip-flop 39; the terminal K of the flip-flop 40 is connected to the terminal Q of the flip-flop 39. The terminal Q of the flip-flop 40 is connected to one of the inputs of the AND gate 42; the terminal Q of the flip-flop 40 is connected on the one hand to the reset-to-zero terminal R of the counter 45 and on the other hand to the clock input of the flip-flop 41. The terminal J and K of this last-mentioned flip-flop are both connected to the positive pole of the source of supply of electric current.

The terminal Q of the flip-flop 41 is connected to one control input 35*a* of the alarm device 35, to one input of a NAND gate 47 and also to one input of an OR gate 48. The output $S_1$ of the counter 45 is connected to another input of the NAND gate 47, while the output $S_2$ of this counter is connected to another, inverting input of the OR gate 48.

The output of the NAND gate 47 and the OR gate 48 are each connected to a respective input of an AND gate 49 having two inputs and the output of which constitutes the output terminal S43 of the circuit 43 and on which is collected the above-mentioned signal B. The output of the AND gate 49 is connected on the one hand to an input of the AND gate 42 and on the other hand to an input of a NOR gate 50 which has two inputs and the output of which is connected to the reset-to-zero terminal R of the flip-flop 40. The second input of the NOR gate 50 is connected to the output contact 37 of the switch 28.

Finally, the reset-to-zero terminal R of the downstream flip-flop 39 is connected to the output terminal 37 of the switch 28 via an inverter 51.

The flip-flops 39, 40 and 41 are flip-flops which respond to trailing edges of the signal applied to their respective clock inputs.

The clock pulse signal H is applied to the clock inputs of the flip-flops 39 and 40 which form the anti-surge circuit.

While there are shown and described one preferred illustrative embodiment of the invention, it will be understood by those skilled in the art that other modifications may be made within the principles of the invention and the scope of the appended claims.

What is claimed is:

1. A timepiece for indicating time data, comprising:

a rotatable stem which is movable axially and can occupy at least two different axial positions, namely a pushed-in position and a pulled-out position;

first setting means responsive to rotation of said stem in its said pulled-out position to alter the indicated time data;

an alarm device having a set condition and an off condition, for, when in its set condition, producing an alarm at a preadjusted time; and control means for changing over the condition of said alarm device;

wherein said stem is further displaceable axially inwards beyond its said stable pushed-in position to a non-stable axial position; and wherein said control means is responsive to the positioning of said stem in said non-stable position for changing-over the condition of said alarm device.

2. The timepiece of claim 1, wherein said stem can also occupy a third stable axial position and the timepiece further comprises second setting means responsive to rotation of said stem, in said third stable axial position, for adjusting said pre-adjusted alarm time.

3. The timepiece of claim 2, further comprising means for indicating a supplementary item of data, and wherein said second setting means is responsive to rotation of said stem in said third stable position (a) in a first direction for adjusting said pre-adjusted alarm time and (b) in the other direction for adjusting said supplementary item of data.

4. The timepiece of claim 3, wherein said supplementary item of data is the day of the month.

5. The timepiece of claims 1 further comprising:

means responsive to (a) a first positioning of said stem in its said non-stable position for providing an electrical signal and to (b) a second positioning of said stem, following the first positioning, in its said non-stable position for providing at least two distinct and consecutive electrical signals, and an electro-acoustic transducer responding to each one of said electrical signals by emitting one acoustic signal.

* * * * *